US008038726B2

(12) United States Patent
Ogle et al.

(10) Patent No.: US 8,038,726 B2
(45) Date of Patent: Oct. 18, 2011

(54) IN-LINE SYSTEM FOR PROCESSING TEXTILE MATERIAL

(75) Inventors: James Russell Ogle, Spartanburg, SC (US); Michael Plantholt, Union, SC (US)

(73) Assignee: Standard Textile Co., Inc., Cincinnati, OH (US)

( * ) Notice: Subject to any disclaimer, the term of this patent is extended or adjusted under 35 U.S.C. 154(b) by 773 days.

(21) Appl. No.: 11/537,193

(22) Filed: Sep. 29, 2006

(65) Prior Publication Data

US 2008/0147230 A1 Jun. 19, 2008

(51) Int. Cl.
*D06M 23/00* (2006.01)

(52) U.S. Cl. ..... 8/115.6; 8/115.51; 8/137

(58) Field of Classification Search ..... 8/115.6, 8/137, 636, 115.51
See application file for complete search history.

(56) References Cited

U.S. PATENT DOCUMENTS

| | | | | |
|---|---|---|---|---|
| 2,253,242 | A | 8/1941 | MacMahon et al. | |
| 2,338,391 | A | 1/1944 | Francis | |
| 3,042,623 | A * | 7/1962 | Greene | 510/426 |
| 3,457,740 | A | 7/1969 | Korsch | |
| 3,597,851 | A | 8/1971 | Arendt et al. | |
| 3,728,073 | A * | 4/1973 | Pleskun | 8/115.64 |
| 4,099,913 | A * | 7/1978 | Walter et al. | 8/477 |
| 4,447,924 | A | 5/1984 | Bolton et al. | |
| 4,710,200 | A * | 12/1987 | Cates et al. | 8/574 |
| 4,741,740 | A * | 5/1988 | Davis et al. | 8/490 |
| 4,908,140 | A | 3/1990 | Bausch et al. | |
| 5,174,790 | A * | 12/1992 | Riggins et al. | 8/490 |
| 5,273,548 | A | 12/1993 | Lapierre et al. | |
| 5,698,476 | A | 12/1997 | Johnson et al. | |
| 5,912,407 | A | 6/1999 | Miller et al. | |
| 6,083,283 | A | 7/2000 | Berkstresser, IV et al. | |
| 6,123,741 | A | 9/2000 | Girbaud et al. | |
| 6,521,000 | B1 | 2/2003 | McFarland et al. | |
| 6,743,761 | B2 | 6/2004 | Wang | |
| 6,869,679 | B1 * | 3/2005 | Negola | 428/364 |
| 6,947,807 | B2 | 9/2005 | Panebianco | |
| 7,008,457 | B2 | 3/2006 | Sivik et al. | |

FOREIGN PATENT DOCUMENTS

| | | | |
|---|---|---|---|
| DE | 3200146 | A1 | 10/1982 |
| DE | 3605994 | A1 | 8/1987 |
| DE | 4300047 | C1 | 6/1994 |
| GB | 2074205 | A | 10/1981 |

OTHER PUBLICATIONS

English Translation of Specification of DE 4300047, 13 pages, Translated by McElroy Translation Company of Austin, Texas.
International Preliminary Report on Patentability for PCT/US2007/074690, mailed Jan. 27, 2009, 13 pages.
International Search Report for PCT/US2007/074690, mailed Dec. 4, 2007 (6 pages).
Written Opinion for PCT/US2007/074690, mailed Dec. 4, 2007 (6 pages).
English Translation of Specification of DE 4300047, 13 pages, Translated by McElroy Translation Company of Austin, Texas.

* cited by examiner

*Primary Examiner* — Amina Khan
(74) *Attorney, Agent, or Firm* — Wood, Herron & Evans, LLP

(57) ABSTRACT

The present invention relates to an in-line system for processing textile material that has been finished beyond a greige state. The in-line system includes an upstream unrolling station adapted to generally continuously pay out the textile material from a roll, a downstream winding station adapted to take up the textile material into another roll, and a plurality of work stations in-line between the upstream unrolling station and the downstream winding station and through which paid out textile material passes. The work stations include at least a finish pad station adapted to apply a finish chemical to the textile material passing therethrough and a wash station adapted to launder the textile material passing therethrough, the wash station being downstream of the finish pad station. The processed textile material is ready for cut and sew operations whereat one or more textile products would be produced and ready for use without further washing.

10 Claims, 1 Drawing Sheet

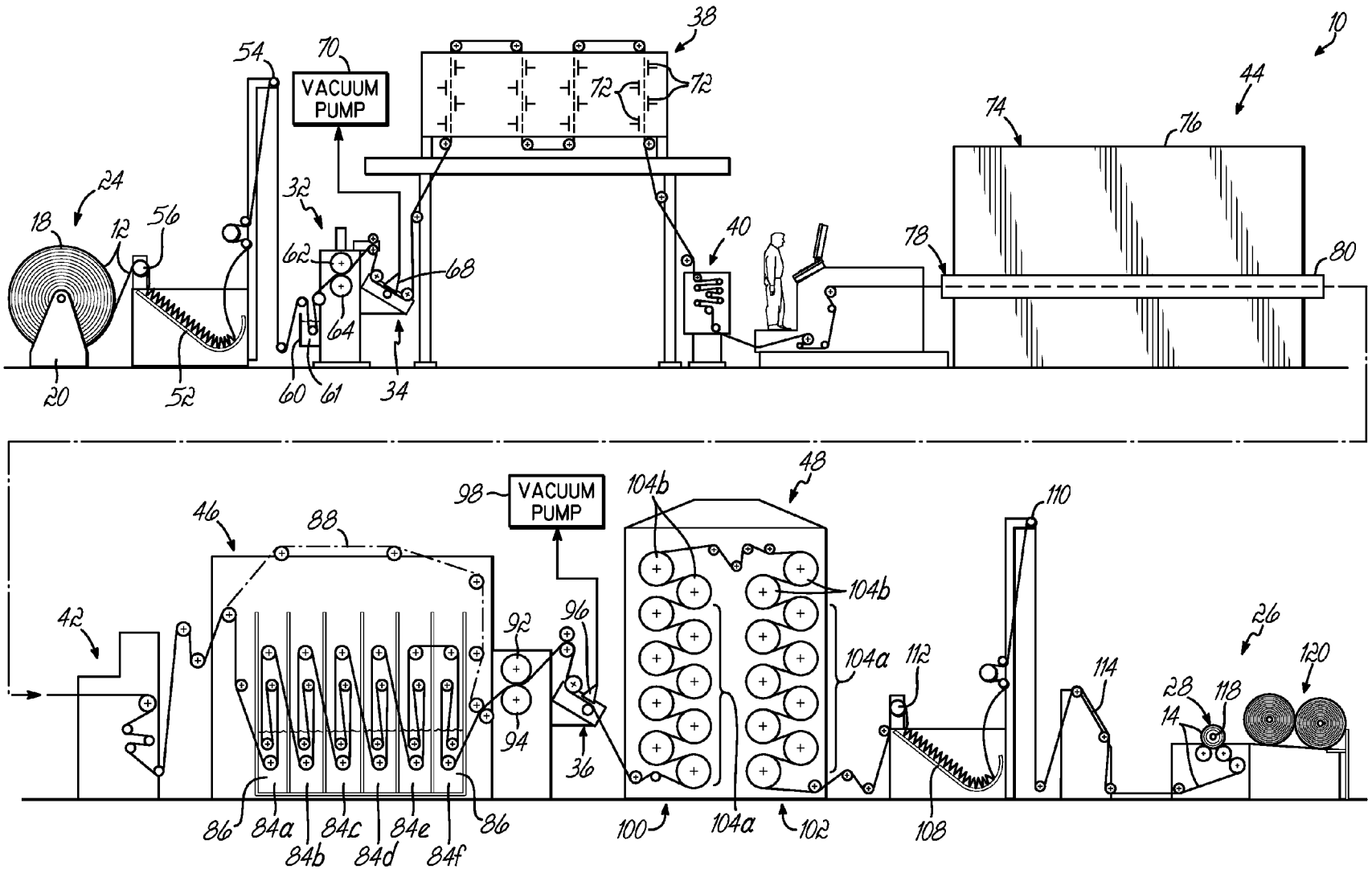
VACUUM PUMP
VACUUM PUMP

IN-LINE SYSTEM FOR PROCESSING TEXTILE MATERIAL

BACKGROUND OF THE INVENTION

1. Field of the Invention

The present invention relates to an in-line system for processing textile material, such as sheeting and the like.

2. Description of Related Art

Ordinarily, in the preparation of textile products, textiles are woven and formed into a roll known as a greige goods roll. Thereafter, the roll is run through various processes where the woven textile may be bleached, sized and exposed to other various finishing processes. Typically, a "finished" roll is sent off to a cut and sew operation where pieces of fabric are cut from the roll and then sewn to form the desired textile product, such as a bed sheet, pillowcase, or clothing product. In many cases, that final product is then shipped to the customers who then must (or rather should) wash the product before use to be sure that all of the chemistry involved from the finishing processes has been removed.

In certain instances, it is desirable to pre-launder textiles before they are shipped to customers. For example, in the current state of the art as we understand it, there are pre-washed jeans. These jeans are washed in batches in large washing machines after the cut and sew operation, which means the laundering operation not only includes the extra weight of any of the stitching threads, (and other items like tags and/or zippers that may be present), but also the added problems of handling all of those piece goods as they come out of the laundry system. In another example, finished textiles may be washed before construction of the final product; such washing may define a continuous process or batch process. As we understand it, when finished textiles are washed before garment construction, they are generally sent from a point A, i.e., a finishing area, to an off-site or segregated point B, which defines a continuous or batch washing area, then to an off-site or segregated point C, which defines a drying area. This misaligned and disjointed arrangement means that the textile operation not only involves costly and untimely extra steps of transferring textiles from one location to another (which includes, for example, multiple unrolling and re-rolling of rolled textiles), but also the added problems of determining how to handle and transfer the textiles as they come out of each area.

SUMMARY OF THE INVENTION

In the present invention, an in-line system for processing textile material that has been finished beyond a greige state and is substantially ready for cut and sew operations includes an upstream unrolling station adapted to generally continuously pay out the textile material from a roll, a downstream winding station adapted to take up the textile material into another roll, and a plurality of work stations in-line between the upstream unrolling station and the downstream winding station and through which the paid out textile material passes. The work stations include at least a finish pad station adapted to apply a finish chemical to the textile material passing therethrough and a wash station adapted to launder the textile material passing therethrough, the wash station being downstream of the finish pad station. The processed textile material, which has a pH of greater than about 6 and less than about 8, is ready for cut and sew operations whereat one or more textile products, such as sheeting and the like, would be produced and ready for use without further washing.

The in-line system eliminates the need for any initial laundering by the ultimate user and also eliminates the need to handle piece goods for laundering. The system further eliminates extra costly and timely steps of transferring textiles from one segregated area to another (which includes, for example, multiple unrolling and re-rolling of rolled textiles) as well as the added problems of determining how to handle and transfer them.

By virtue of the foregoing, there is thus provided an in-line system for producing a pre-laundered textile material from a roll of textile material that has been finished beyond a greige state and is substantially ready for cut and sew operations whereat one or more textile products would be produced from the pre-laundered textile material and ready for use without further washing.

These and other objects and advantages of the present invention shall be made apparent from the accompanying drawings and the description thereof.

BRIEF DESCRIPTION OF THE DRAWINGS

The accompanying drawing, which is incorporated in and constitutes a part of this specification, illustrates embodiments of the invention and, together with the general description of the invention given above and the detailed description of the embodiments given below, serves to explain the principles of the present invention.

The FIGURE is a schematic illustration depicting an embodiment of the in-line system and associated method in accordance with the principles of the present invention.

DETAILED DESCRIPTION OF THE DRAWINGS

With reference to the FIGURE, an embodiment of an in-line system 10 for processing textile material 12 in accordance with the principles of the present invention is shown. The type of textile material 12 that may be processed using the inline system 10 can include knitted fabrics, woven fabrics, or non-woven fabrics prepared from yarns or individual fibers, such yarns or individual fibers including natural fibers, synthetic fibers, and combinations or blends thereof. Such processed textile material 14 has a pH of greater than about 6 and less than about 8 and is ready for cut and sew operations into one or more textile products (not shown), e.g., bed sheeting and the like, such products being ready for use without further washing.

To this end, textile material 12 for processing via the in-line system 10, such as a woven fabric including a 50/50 polycotton blend with a fabric weight of 4 ounces per square yard, is initially received as a roll of greige goods (not shown). Once received, this roll is first run through customary processing or finishing steps, as known to those having ordinary skill in the art, which include, for example, singeing, malting, mercerizing, kiering, bleaching, and/or sizing so that the roll of greige goods is finished beyond a greige state and is substantially ready for cut and sew operations.

The initially processed roll 18 of textile material 12 then is rotatably situated on a transportable carrying frame 20, or A-frame, which may hold up to about 15,000 yards of textile material 12. The A-frame 20 and roll 18 of textile material 12 together define the upstream unrolling station 24 of the in-line system 10. Such unrolling station 24 is positioned in-line with a plurality of work stations including, for example, a finish pad station 32, vacuum stations 34 and 36, a dye setting station 38, cloth straightener stations 40 and 42, a tenter oven station 44, a wash station 46, and a drying station 48 as well as a downstream winding station 26. In use, the unrolling station 24 generally continuously pays out the textile material 12 which passes downstream through the work stations for further processing, including final finishing and washing, with the winding station 26 taking up the processed textile material 14 into another roll 28, as further discussed below. With respect to the textile material 12 being generally continuously paid out, it should be understood by one having ordinary skill in the art that the textile material 12, on occasion, may sit stationary at a point(s) along the length of the in-line system 10 such that the textile material 12 may not necessarily be continuously paid out but rather is generally continuously paid out from the unrolling station 24.

Accordingly, as shown in the FIGURE, paid out textile material 12 from the unrolling station 24 is initially collected downstream in a scray pan 52, then run over a sky roll 54 prior to entering the finish pad station 32. At least one driven and elastomeric covered roller 56 is positioned at the entry to the scray pan 52 to create a desired degree of friction to help pay out the text material 12 from the roll 18.

From the sky roll 54, textile material 12 enters the finish pad station 32, which includes a trough 60 for holding a chemical bath 61 including one or more finish chemicals and for applying the finish chemical(s) to the textile material 12 as it passes therethrough so as to impart certain final finish properties to the textile material 12. Such final finish properties can include, for example, shrinkage control, softness, shade, stain and water repellency, sewability, and others known to those having ordinary skill in the art. The finish chemicals responsible for imparting the final finish properties may include, for example, resins, organic and silicone softeners, polyethylene, fluorocarbon finishes, tints, pigment dyes, optical brighteners, and the like.

The finish pad station 32 also includes a "nip" or uniform pressure zone that is created between two parallel and driven nip rollers 62 and 64 with one roller 62 being provided with an elastomeric covering to help move along the textile material. After the textile material 12 exits the trough 60, it passes between the closely spaced rollers 62, 64, which create about five tons of pressure, so that excess liquid, such as excess finish chemicals, may be squeezed therefrom.

After the nip rollers 62, 64, textile material 12 enters vacuum station 34 that includes a vacuum 68, which is operably connected to a vacuum pump 70, for extracting additional moisture from the textile material 12 passing therethrough. The vacuum 68 may operate at about 10 to about 12 inches of mercury for extracting moisture.

From the vacuum station 34, the textile material 12 enters the dye setting station 38 which includes a plurality of ceramic tiles 72 that may be heated, e.g., between about 1200° F. to about 1800° F., so as to heat the textile material 12 and set dye therein as textile material 12 passes therethrough.

Cloth straightener station 40, e.g., a mahlo skew unit, is positioned after the dye setting station 38 and includes visual alignment sensors (not shown) to help keep the textile material 12 properly aligned as it passes therethrough.

Textile material 12 leaving the cloth straightener station 40 then enters the tenter oven station 44, which includes a tenter oven 74 for drying the textile material 12 passing therethrough and for leaving the finish chemical to cure thereon. The tenter oven 74 includes a housing 76 and tenter frame 78 that extends through the housing 76. The tenter frame 78, as is known to those having ordinary skill in the art, includes opposing rails 80 (only one shown) and associated driven clips (not shown) for securing the side edges of the textile material 12 thereto and for moving the textile material 12 through the housing 76. The housing 76 may be heated to about 200° F. to about 300° F. to dry the textile material 12. As a result of being secured and suspended by the clips, the textile material 12 stretches as it dries.

The textile material 12 exits the tenter oven station 44 and enters cloth straightener station 42, which includes visual alignment sensors (not shown) to help keep the textile material 12 properly aligned as it passes therethrough.

From cloth straightener station 42, the textile material 12 enters the wash station 46 for laundering textile material 12 passing therethrough. The wash station 46 includes a number of washtubs, six of which are shown and represented by numerals 84*a*, 84*b*, 84*c*, 84*d*, 84*e*, and 84*f*. These washtubs 84*a-f* have corresponding rollers for twice passing the textile material 12 through a liquid bath 86 in each washtub 84*a-f*. The liquid baths 86 of the first three washtubs 84*a-c* are provided with a mixture of water and surfactant so as to clean the textile material 12 whereas the liquid baths 86 of the last three washtubs 84*d-f* are provided with water and no surfactant for rinsing the textile material 12. The liquid bath 86 in the washtubs 84*a-f* may include a pH of between about 6 to about 8 and may have a temperature of no less than about 100° F. and no greater than about 205° F. In addition, the liquid inflow for the washtubs 84*a-f* is about 10 gpm to about 30 gpm. The wash station 46 also has a bypass route 88, which includes a series of rollers, for redirecting the textile material 12 around the wash station 46 if laundering is not desired.

The wash station 46, like the finish pad station 32, further includes a nip created between two parallel driven nip rollers 92 and 94 with one roller 92 being provided with an elastomeric covering to help move along the textile material 12. After the textile material 12 exits the last washtub 84*f*, it is passed between closely spaced rollers 92 and 94, which create about five tons of pressure, so that liquid may be squeezed therefrom.

From the nip rollers 92, 94, textile material 12 enters vacuum station 36 that includes vacuum 96, which is operably connected to vacuum pump 98, for extracting moisture from textile material 12 passing therethrough. The vacuum 96 may operate at about 10 to about 12 inches of mercury for extracting moisture from the textile material 12.

Textile material 12 exiting vacuum station 36 then enters the drying station 48 for drying textile material 12 passing therethrough. The drying station 48, in one embodiment, includes two columns 100 and 102 of eight rotatably driven drying cans 104*a* and two rotatably connected topside drying cans 104*b* all of which are steam heated to a temperature of between about 200° F. and 300° F. for drying the textile material 12. The textile material 12 generally winds its way about each drying can 104*a* and 104*b* through the drying station 48, such rotatably driven drying cans 104*a* helping to move the textile material 12 along.

After exiting the drying station 48, textile material 12 collects in an exit scray pan 108 then is run over sky roll 110. At least one driven and elastomeric covered roller 112 is positioned at the entry to the exit scray pan 108 to create a desired degree of friction to help move along the textile material 12. From the sky roll 110, the textile material 12 passes by an inspection board 114 for inspection thereof, then finally ends up at the winding station 26 which includes a driven roller 118 that not only winds the textile material 12 into roll 28 but also helps pay out, or unroll, the textile material 12 from roll 18. In use, the in-line system 10 can output about 80 yards to about 150 yards of textile material per minute. After re-rolling, the roll 28 of processed textile material 14 may be removed therefrom and staged at a roll take-up area 120 where it can be transported for cutting and sewing into a finished product.

Accordingly, each of the stations 24, 26, 32, 34, 36, 38, 40, 42, 44, 46, 48 of this system 10 are positioned in-line with one another so that the textile material 12 of roll 18 is fed generally continuously from the unrolling station 24, through each of the work stations 32, 34, 36, 38, 40, 42, 44, 46, 48, to the winding station 26 whereat it is re-rolled. The re-rolled and now pre-laundered textile material 14 includes a pH of greater than about 6 and less than about 8 and is ready for cut and sew operations into one or more textile products, such as bed sheeting and the like, that is ready for use without further washing. Although the system 10 is described herein as being an "in-line" system 10, it should be understood by one having ordinary skill in the art that the stations 24, 26, 32, 34, 36, 38, 40, 42, 44, 46, 48 need not necessarily form a straight line or substantially straight line insofar as the textile material 12 may be manipulated to move, for example, in a left or right direction as well as an up or down direction; such in-line system 10, thus, may define a serpentine-like footprint, for example.

By virtue of the foregoing, there is thus provided an in-line system 10 for processing textile material 12 that has been finished beyond a greige state and is substantially ready for cut and sew operations whereat one or more textile products would be produced from a roll and ready for use without further washing.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, although the stations 24, 26, 32, 34, 36, 38, 40, 42, 44, 46, 48 are described as individualized, two or more stations may be combined into a single station, such as finish pad station 32 and vacuum station 34 or wash station 46 and vacuum station 36, to reduce the size or footprint of the system. In addition, it should be understood that certain work stations may be rearranged and that one or more work stations may be completely removed from the in-line system, yet still provide the processed textile material 14. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. A method for processing textile material that has been finished beyond a greige state and is substantially ready for cut and sew operations whereat one or more textile products would be produced from a roll and ready for use without further washing, the method comprising:

generally continuously paying out the textile material from an upstream roll;

taking up the textile material into a downstream roll; and therebetween and in-line, applying a finish chemical to the textile material, subjecting the textile material to a tenter oven, laundering the textile material, which includes cleaning the textile material in a liquid having a surfactant and a pH of about 6 to about 8 and rinsing the textile material with a liquid having a pH of about 6 to about 8, then drying the textile material, and further wherein the method, between generally continuously paying out the textile material and taking up the textile material, is free from a step of dyeing the textile material, such that the textile material includes a pH of greater than about 6 and less than about 8 and is ready for cut and sew operations whereat one or more textile products would be produced and ready for use without further washing.

2. The method of claim 1 further comprising subjecting the taken up textile material to cut and sew operations to produce said one or more textile products.

3. The method of claim 1 wherein the finish chemical is left to cure on the textile material.

4. The method of claim 1 further comprising, between generally continuously paying out the textile material from an upstream roll and taking up the textile material into a downstream roll, keeping the textile material properly aligned.

5. The method of claim 1 further comprising, between applying a finish chemical to the textile material and laundering the textile material, keeping the textile material properly aligned.

6. The method of claim 1 further comprising, between applying a finish chemical to the textile material and subjecting the textile material to a tenter oven, vacuuming moisture from the textile material.

7. The method of claim 1 further comprising, between laundering the textile material and drying the textile material, vacuuming moisture from the textile material.

8. The method of claim 1 wherein drying the textile material includes drying the textile material over a plurality of drying cans.

9. The method of claim 1 wherein generally continuously paying out the textile material from an upstream roll includes generally continuously unrolling the textile material from the upstream roll.

10. The method of claim 1 wherein the liquid having a surfactant and pH of about 6 to about 8 has a temperature of about 100° F. to about 205° F.

* * * * *